US009909542B2

(12) United States Patent
Rother

(10) Patent No.: US 9,909,542 B2
(45) Date of Patent: Mar. 6, 2018

(54) FRESH AIR SYSTEM

(71) Applicant: Mahle International GmbH, Stuttgart (DE)

(72) Inventor: Thilo Rother, Stuttgart (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 14/910,679

(22) PCT Filed: Jul. 29, 2014

(86) PCT No.: PCT/EP2014/066225
§ 371 (c)(1),
(2) Date: Feb. 5, 2016

(87) PCT Pub. No.: WO2015/018689
PCT Pub. Date: Feb. 12, 2015

(65) Prior Publication Data

US 2016/0186702 A1 Jun. 30, 2016

(30) Foreign Application Priority Data

Aug. 7, 2013 (DE) ..... 10 2013 215 607

(51) Int. Cl.
*F02M 35/02* (2006.01)
*F02M 35/10* (2006.01)
(Continued)

(52) U.S. Cl.
CPC ..... *F02M 35/0203* (2013.01); *F02M 35/024* (2013.01); *F02M 35/10091* (2013.01);
(Continued)

(58) Field of Classification Search
CPC ..... F02M 35/0203; F02M 35/024; F02M 35/10091; F02M 35/10137; F02M 35/10144; F02M 35/1255
(Continued)

(56) References Cited

U.S. PATENT DOCUMENTS 4,778,029 A 10/1988 Thornburgh
5,129,685 A 7/1992 Engel
(Continued)

FOREIGN PATENT DOCUMENTS

DE 8522392 U1 10/1985
DE 19632205 A1 4/1998
(Continued)

OTHER PUBLICATIONS

English abstract for JPH8114120A.
(Continued)

*Primary Examiner* — John Kwon
*Assistant Examiner* — Johnny H Hoang
(74) *Attorney, Agent, or Firm* — Fishman Stewart PLLC

(57) ABSTRACT

A fresh air system for an internal combustion engine may include an inlet section, an air filter and a connecting section fluidly connecting the inlet section to the air filter. The air filter may include a filter element arranged in a filter housing, and a housing cover closing the filter housing and configured to be removable from the filter housing to change the filter element. The connecting section may be movably connected to the inlet section on an inlet side and detachably connected to the housing cover on an outlet side. To change the filter element when the inlet section is connected to the connecting section, the connecting section may be detachable from the housing cover and adjustable relative to the filter housing to such an extent that the housing cover can be removed from the filter housing.

19 Claims, 5 Drawing Sheets

(51) Int. Cl.
*F02M 35/12* (2006.01)
*F02M 35/024* (2006.01)

(52) U.S. Cl.
CPC ..... *F02M 35/10137* (2013.01); *F02M 35/10144* (2013.01); *F02M 35/1255* (2013.01)

(58) Field of Classification Search
USPC ..... 123/184.21, 184.24, 184.36, 184.51, 123/195 C, 195 P, 198 E
See application file for complete search history.

(56) References Cited

U.S. PATENT DOCUMENTS

| | | | |
|---|---|---|---|
| 5,134,977 | A | 8/1992 | Bagger et al. |
| 5,195,484 | A | 3/1993 | Knapp |
| 5,679,045 | A | 10/1997 | Niemi |
| 6,178,940 | B1 | 1/2001 | Gossling et al. |
| 6,463,901 | B1 | 10/2002 | Cuddihee, Sr. et al. |
| 7,501,004 | B2 | 3/2009 | Tschech et al. |
| 8,152,880 | B2 | 4/2012 | Matschl et al. |
| 8,236,079 | B2 | 8/2012 | Fasan |
| 8,485,153 | B2 | 7/2013 | Satarino et al. |
| 2008/0028938 | A1 | 2/2008 | Li |
| 2012/0031688 | A1 | 2/2012 | Safranski et al. |
| 2013/0118434 | A1* | 5/2013 | Jun ..... F02M 35/14 123/184.57 |
| 2015/0267653 | A1* | 9/2015 | Kinsey, Jr. ..... F02M 35/02483 123/198 E |
| 2015/0267655 | A1* | 9/2015 | Madeira ..... F02M 35/164 123/184.21 |

FOREIGN PATENT DOCUMENTS

| | | | |
|---|---|---|---|
| DE | 102005010443 | A1 | 3/2006 |
| DE | 102007021756 | A1 | 11/2008 |
| DE | 102007046218 | A1 | 4/2009 |
| DE | 202008005603 | U1 | 9/2009 |
| DE | 102009024662 | A1 | 9/2010 |
| DE | 102011015238 | A1 | 9/2012 |
| EP | 0065183 | A1 | 11/1982 |
| EP | 989295 | A2 | 3/2000 |
| EP | 2472094 | A1 | 7/2012 |
| JP | 08-114120 | A | 5/1996 |
| WO | WO-9508731 | A1 | 3/1995 |
| WO | WO-2004055355 | A1 | 7/2004 |
| WO | WO-2012147729 | A1 | 11/2012 |

OTHER PUBLICATIONS

English abstract for DE-8522392U1.
English abstract for DE102011015238A1.
English abstract for DE19632205.

* cited by examiner

FRESH AIR SYSTEM

CROSS-REFERENCE TO RELATED APPLICATIONS

This application claims priority to German Patent Application No. 10 2013 215 607.3, filed Aug. 7, 2013, and International Patent Application No. PCT/EP2014/066225, filed Jul. 29, 2014, both of which are hereby incorporated by reference in their entirety.

TECHNICAL FIELD

The present invention relates to a fresh air system for an internal combustion engine.

BACKGROUND

An internal combustion engine is equipped with a fresh air system to supply combustion chambers of the internal combustion engine. Such a fresh air system extends in the usual manner from an inlet, via which the fresh air enters the fresh air system from an environment, to an outlet section, from which the fresh air is distributed to the individual combustion chambers of the internal combustion engine. Different components of the fresh air system can be arranged between the inlet section and the outlet section. Generally, at least one air filter is arranged between the inlet section and the outlet section, said air filter having a filter element in a filter housing in order to filter the fresh air supplied to the internal combustion engine. Furthermore, at least one silencer, an air flow meter, a charge device and a charge air cooler, for example, can be arranged in a fresh air system.

In certain installation situations, in particular in vehicles, it is often desirable for the inlet section and the filter housing each to be connected fixedly to a periphery of the internal combustion engine, as a result of which said components are arranged for example in a stationary manner in an engine compartment of a vehicle. In any case, the inlet section and the filter housing are arranged in a stationary manner relative to each other. It can also be necessary for reasons of installation space to connect the inlet section via a connecting section to a housing cover of the filter housing, which acts to close the filter housing and can be removed to change the filter element. In this case, the connection between the above-mentioned connecting section and the housing cover must previously be undone in order to be able to remove the housing cover from the housing, to change the filter element. However, this is comparatively laborious, since the inlet section, which is connected to the connecting section, is connected fixedly to the periphery of the internal combustion engine when the fresh air system is in the installed state. This makes the structure of the fresh air system comparatively complex. Exchanging a filter element is also comparatively complex as a result.

SUMMARY

The present invention is concerned with the problem of specifying an improved embodiment for a fresh air system of the above-described type, which is in particular characterised by simpler handling while the filter element is being changed. A structure that is simple to implement is also intended.

This problem is solved according to the invention by the subject matter of the independent claim(s). Advantageous embodiments form the subject matter of the dependent claims.

The invention is based on the general concept of arranging the connecting section, which serves to connect the inlet section to the housing cover, detachably on the housing cover on the outlet side and on the inlet section on the inlet side in a movable manner to such an extent that the connecting section has sufficient adjustability relative to the filter housing to allow the housing cover to be removed from the filter housing. The movable arrangement of the connecting section on the inlet section means that the connection between connecting section and inlet section does not have to be undone or separated in order to be able to remove the housing cover from the filter housing. This makes the fresh air system easier to handle while changing a filter element.

An embodiment in which the connecting section is arranged on the inlet section such that it can be moved around a pivot axis is particularly advantageous. With the aid of such a pivot axis, a predefined degree of freedom is defined for the relative movement of the connecting section relative to the inlet section and thus relative to the filter housing, which makes the fresh air system easier to handle during a filter change. The defined pivot axis produces a rotary movement for the connection section about the pivot axis, as a result of which the connecting section can be moved virtually along an arc path out of the installation space necessary for removing the housing cover. A rotary movement has the advantage over an axial movement that the connecting section and the inlet section can be relatively rigid, as a result of which they are comparatively simple to produce. In contrast, with a linear movement, in particular with a telescopic linear movement, relative movements insides the connecting section and/or inlet section are necessary, as a result of which the structures necessary for this are comparatively complex.

An embodiment is particularly advantageous in which the connecting section is connected directly to the inlet section on one side and directly to the housing cover on the other side, so that ultimately only one component, namely the connecting section, is necessary to connect the inlet section to the housing cover. This also results in an extreme simplification for the structure of the fresh air system.

In one advantageous embodiment, the inlet section can be connected to the connecting section by means of a plug-in connection, with which an inner part is inserted axially into an outer part. This simplifies the assembly between connecting section and inlet section. A radial gap can then be formed particularly expediently between the inner part and the outer part, in which gap is arranged an elastic compensating body, which runs around in the circumferential direction, preferably in a closed manner. The deliberately provided radial gap allows a relative movement between inner part and outer part. The elastic compensating body serves to prevent direct contact between inner part and outer part, as a result of which the risk of annoying noise can also be reduced. The compensating body can also fulfil a certain sealing function, to prevent incorrect intake of air in the region of the plug-in connection. The compensating body therefore preferably runs around in a closed manner in the circumferential direction. The plug-in connection with the radial gap means that a mobility between connecting section and inlet section is implemented in the plug-in connection. Corresponding dimensioning of the radial gap means that the mobility between connecting section and inlet section inside the plug-in connection can be sufficient to move the connecting section relative to the filter housing so far that the housing cover can be removed from the filter housing. The adjustability according to the invention between connecting section and inlet section is thus implemented by means of the plug-in connection with radial play. In particular, the above-mentioned pivot axis between connecting section and inlet section is also defined inside said plug-in connection.

According to an advantageous development, the compensating body can be a foam body. Such foam bodies, in particular consisting of plastic, are comparatively simple to produced and have high long-term elasticity. At the same time, sufficient adaptation of shape can be realised by the foam body, so that the radial gap can be filled particularly easily, in particular completely closed in the circumferential direction, with the aid of the foam body. The foam body can be open-pored or closed-pored. Furthermore, the foam body can be applied to an inner face of the inner part or to an outer face of the outer part. The connection between the foam body and the inner or outer face can for example be formed by adhesive bonding or fusing.

In another development, an axial overlap between inner part and outer part can be at least as large as a diameter of the inner part. In this manner, sufficient positioning is maintained between the connecting section and the inlet section inside the plug-in connection, even with comparatively large relative movements between connecting section and inlet section.

According to another development, the compensating body can project axially over the plug-in connection. This measure makes it possible in principle to use the compensating body for an additional function outside the plug-in connection. For example, the compensating body can support the inner part elastically on the periphery of the internal combustion engine. If the inner part is formed on the inlet section, support of the inlet section can be achieved on the periphery of the internal combustion engine proximally to the plug-in connection, by means of the region of the compensating body that projects out of the plug-in connection.

In another advantageous development, the plug-in connection can define a flat cross section, which has a long diameter and, transversely thereto, a short diameter. This measure in particular allows the above-mentioned pivot axis to be defined particularly simply inside the plug-in connection. Owing to the flat cross section, the pivot axis necessarily extends parallel to the long diameter of the flat cross section of the plug-in connection. The spatial position of the pivot axis between connecting section and inlet section can thus be predefined by the spatial orientation of the plug-in connection or of the flat cross section thereof.

According to another advantageous embodiment, the connecting section can be fixed to the housing cover by means of a locking connection, which has a predefined assembly direction. This means that the connecting section must be attached to the housing cover in said assembly direction for the locking connection to lock in order to fix the connecting section to the housing cover. Said assembly direction can expediently extend perpendicularly to the pivot axis, so the movement of the connecting section predefined by the pivot axis takes place in the assembly direction, at least on the outlet side of the connecting section. Assembly can be made considerably simpler thereby.

If the plug-in connection has the above-mentioned flat cross section, the assembly direction runs substantially perpendicular to the long diameter of the flat cross section.

In another embodiment, the connecting section can have a first flat cross section on the inlet section and a second flat cross section on the housing cover, which is rotated approximately 90° in relation to the first flat cross section. In other words, a first long diameter of the first flat cross section runs approximately perpendicularly to a second long diameter of the second flat cross section. While the first long diameter preferably runs parallel to the above-mentioned pivot axis of the connecting section, the second long diameter preferably extends parallel to the above-mentioned assembly direction.

In another embodiment, the connecting section can be connected to the housing cover by means of a locking connection, which has at least one manually operated unlocking element for undoing the locking connection. With the aid of such an unlocking element, the locking connection can be manually undone particularly simply, in order to separate the connecting section from the housing cover and to be able to remove the housing cover from the filter housing. According to an advantageous development, the unlocking element can be formed directly on a locking element of the locking connection and in particular be formed integrally thereon.

According to another embodiment, at least one positioning element can be formed on the connecting section, said positioning element interacting with at least one complementary counter positioning element formed on the housing cover to position and/or align the connecting section relative to the housing cover. The interacting elements effect a forced and thus automatic optimal alignment of the connecting section relative to the housing cover when the connecting section is attached to the housing cover, as a result of which assembly is considerably simplified.

According to an advantageous development, the respective positioning element and/or the respective counter positioning element can be wedge- or ramp-shaped. Furthermore, the respective positioning element and the respective counter positioning element are expediently aligned such that they drive the connecting section against the housing cover in an axial direction running transversely to the assembly direction when the connecting section is mounted on the housing cover. In particular, a desired relative position can be produced particularly simply between connecting section and housing cover.

According to an expedient development, a locking element and optimally at least one releasing element can be integrated in at least one such positioning element and/or in at least one such counter positioning element. The functions of positioning and alignment on the one hand and of locking and where applicable releasing on the other hand can thus be integrated in the same constituent parts of connecting section and housing cover. Such a high function density reduces production costs and simplifies handling.

In another advantageous embodiment, the connecting section and/or the inlet section can be assembled from two shell bodies, which are each produced integrally as injection-moulded parts. The connecting section and the inlet section can be produced particularly inexpensively thereby.

According to another embodiment, a resonator can be arranged on the connecting section. Such a resonator is characterised by a resonance chamber, through which flow does not pass. Such a resonator can be designed for targeted damping of certain frequencies or frequency ranges, for example to reduce sound propagation through the fresh air system counter to the flow direction of the fresh air into the environment.

The integration of such a resonator in the connecting section gives the connecting section an additional function. At the same time, it is made much easier to attach a resonator in the fresh air system.

According to an advantageous development, the resonator can have a resonator housing formed integrally on the connecting section and a separate resonator cover, which is fastened to the resonator housing. This produces a structure that can be implemented particularly simply and thus inexpensively.

Further important features and advantages of the invention can be found in the subclaims, the drawings and the associated description of the figures using the drawings.

It is self-evident that the above-mentioned features and those still to be explained below can be used not only in the combination given in each case but also in other combinations or alone without departing from the scope of the present invention.

Preferred exemplary embodiments of the invention are shown in the drawings and are explained in more detail in the description below, the same reference symbols referring to the same or similar or functionally equivalent components.

BRIEF DESCRIPTION OF THE DRAWINGS

In the figures.

DETAILED DESCRIPTION

Figure 1:
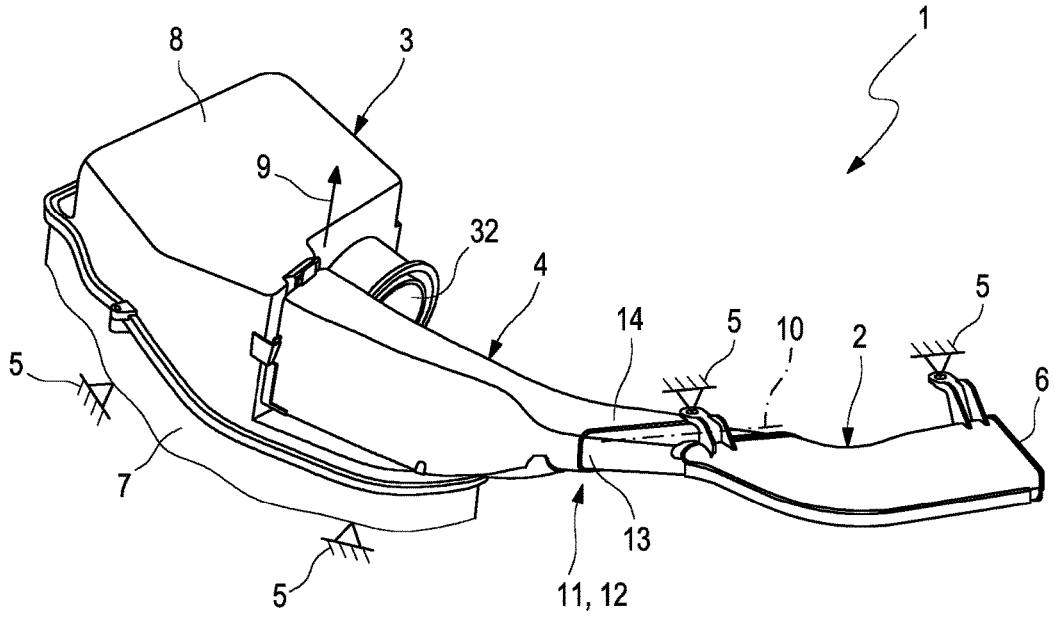
FIG. 1 schematically shows an isometric view of a section of a fresh air system, FIGS. 2*a*, 2*b* and 2*c* schematically show an enlarged view of the fresh air system in the region of a connection between a connecting section and a housing cover in different states, FIG. 3 schematically shows an isometric sectional view of the fresh air system in the region of a connection between the connecting section and an inlet section, FIG. 4 schematically shows an isometric view of the fresh air system in the region of the connection between the connecting section and the housing cover in a different embodiment, FIG. 5 schematically shows a view as in FIG. 4, but from another viewing direction, FIG. 6 schematically shows an isometric view of the fresh air system as in FIG. 1, but in a different embodiment, FIG. 7 schematically shows a view of the fresh air system in the region of a connection between the connecting section and the housing cover, but in the embodiment shown in FIG. 6, FIG. 8 schematically shows a view as in FIG. 7, but from another viewing direction.

According to FIGS. 1 to 8, a fresh air system 1, only part of which is shown here, which is used to supply combustion chambers of an internal combustion engine (not shown here) with fresh air when installed, comprises an inlet section 2, an air filter 3 and a connecting section 4.

In the installed state, the inlet section 2 is connected fixedly to a periphery 5 (only indicated symbolically here) of the internal combustion engine. Usually, the internal combustion engine is arranged in an engine compartment of a vehicle, so that the periphery 5 can be represented by attachment points inside said engine compartment. The inlet section 2 has an inlet opening 6, through which fresh air can enter the fresh air system 1 from an environment. The inlet opening 6 can in this case in principle open directly into said environment. It is likewise possible for the inlet opening 6 to adjoin a correspondingly shaped air inlet (not shown here).

The air filter 3 has filter housing 7, which is shown here merely by way of illustration and is likewise connected fixedly to the periphery 5 when the fresh air system 1 is in the installed state. In the filter housing 7 is arranged a filter element (not shown here), through which the fresh air flows in order to be cleaned during operation of the fresh air system 1. The air filter 3 also has a housing cover 8, which serves to close the filter housing 7, the housing cover 8 being detachably mounted on the filter housing 7 in order to be able to remove the housing cover 8 from the filter housing 7 to change the filter element. If a pot-shaped housing cover 8 is provided, as is the case here, the filter element can also be arranged in the housing cover 8. It is likewise possible for the filter element to extend at least partially inside the filter housing 7 and partially inside the housing cover 8. In any case, the respective filter element is located in an inner space enclosed by the filter housing 7 and by the housing cover 8, so that the housing cover 8 must be removed from the filter housing 7 to change the filter element.

The connecting section 4 is used for the fluid connection of the inlet section 2 to the air filter 3, the connecting section 4 being movably connected to the inlet section 2 on the inlet side and being detachably connected to the housing cover 8 on the outlet side. To change the filter element, the connecting section 4 is detachable from the housing cover 8 and adjustable relative to the filter housing 7 to such an extent that the housing cover 8 can be removed from the filter housing 7. This adjustability of the connecting section 4 is also present when the connecting section 4 is connected to the inlet section 2 and when the inlet section 2 is connected fixedly to the periphery 5. An adjustment movement of the connecting section 4 relative to the housing cover 8 is indicated in each case by an arrow and labelled 9 in FIGS. 1, 2*b* and 2*c*. A rotary adjustability of the connecting section 4 relative to the inlet section 2 is preferred. The rotation of the connecting section 4 takes place in relation to a rotation axis or pivot axis 10, which is shown in FIGS. 1 and 2*c* and runs through a connecting region 11 in which the connecting section 4 is connected movably to the inlet section 2. It can be seen that the adjustment movement 9 extends perpendicularly to the pivot axis 10 or tangentially along a circular path about the pivot axis 10.

Figure 3:
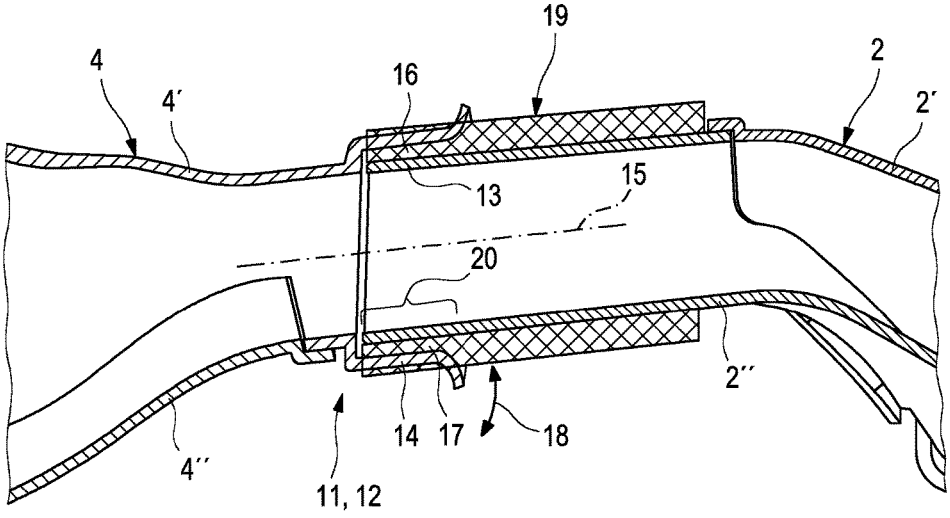
Figure 4:
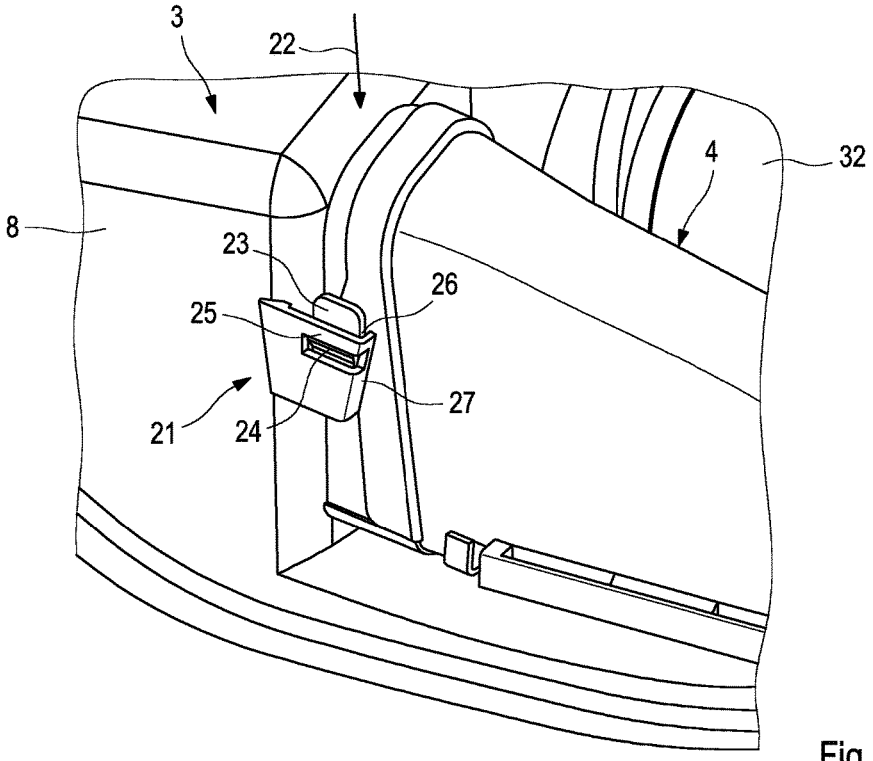
Figure 5:
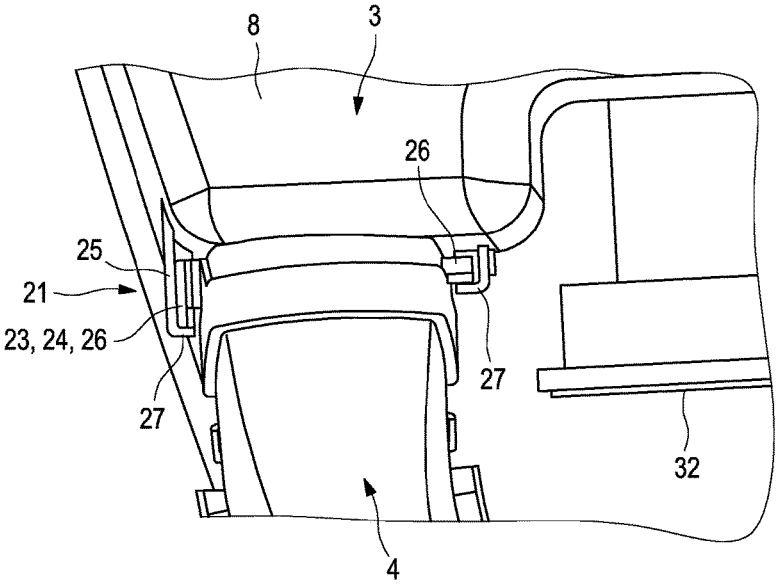

The connecting region 11 is preferably formed as a plug-in connection 12, so that the inlet section 2 is connected to the connecting section 4 via the plug-in connection 12. With this plug-in connection 12, an inner part 13 and an outer part 14 are inserted axially into each other according to FIGS. 1 and 3, the axial direction coinciding with a longitudinal centre axis 15 indicated in FIG. 3, which is defined by the connecting region 11 or by the plug-in connection 12. The inner part 13 is inserted axially into the outer part 14. In the preferred example shown here, the inner part 13 is a constituent of the inlet section 2, while the outer part 14 is a constituent of the connecting section 4. An inverse design is likewise possible. With reference to the longitudinal centre axis 15, a radial gap 16, which can be seen in FIG. 3, is formed radially between the inner part 13 and the outer part 14, by means of which radial gap inner part 13 and outer part 14 are movable relative to each other in the radial direction, that is, perpendicular to the longitudinal centre axis 15. In this radial gap 16 is arranged an elastic compensating body 17, which runs around, preferably in a closed manner, in a circumferential direction 18 in relation to the longitudinal centre axis 15, said circumferential direction being indicated in FIG. 3 by a double arrow. The compensating body 17 is preferably a foam body 19. The foam body 19 can be produced separately from the inlet section 2 and separately from the connecting section 4 and attached thereto in a suitable manner. For example, the foam body 19 can be adhesively bonded to the inner part 13, that is, to the inlet section 2. It is likewise possible in principle for the foam body 19 to be formed directly on the inner part 13 and/or on the outer part 14, namely foamed.

According to FIG. 3, the inner part 13 and the outer part 14 have an axial overlap 20, which is indicated by a curly bracket and can for example be at least as large as a diameter of the inner part 13. The isometric view of FIG. 3 means that the smallest diameter of the inner part 13, which has a flat cross section here, cannot be seen. According to FIG. 3, it is also provided here for the compensating body 17 or the foam body 19 to project axially over the plug-in connection 12. It can be seen that the compensating body 17 in the embodiment shown in FIG. 3 extends parallel to the axial direction approximately twice as far outside the plug-in connection 12 as inside the plug-in connection 12.

The plug-in connection 12 defines a flat cross section, which can be seen in particular in FIG. 1. The flat cross section has a long diameter, which is not shown here and extends parallel to the pivot axis 10, and a short diameter, which runs perpendicularly thereto and is likewise not shown here. The flat cross section in particular allows the spatial orientation of the pivot axis 10 to be defined, since the latter necessarily runs parallel to the long diameter.

According to FIGS. 2 and 4 to 8, the connecting section 4 can expediently be fixed to the housing cover 8 by means of a locking connection 21. Said locking connection 21 has an assembly direction 22, which is indicated by an arrow in FIGS. 2, 4 and 7 and is oriented in the opposite direction to the movement direction 9. The assembly direction 22 and the movement direction 9 extend perpendicularly to the long diameter of the flat cross section of the plug-in connection 12 and perpendicularly to the pivot axis 10, respectively. The assembly direction 22 thus also runs tangentially along a circular path about the pivot axis 10.

As can also be seen in particular in FIG. 1, the connecting section 4 has a first flat cross section on the inlet side, that is, on the inlet section 2, said first cross section having a first long diameter (not shown here), and a second flat cross section on the outlet side, that is, on the housing cover 8, said second cross section having a second long diameter (likewise not shown here). The two flat cross sections are rotated by approximately 90° relative to each other. As a result, the first long diameter runs substantially parallel to the pivot axis 10, while the second long diameter runs substantially parallel to the assembly direction 22 and parallel to the movement direction 9.

As can also be seen in FIGS. 2 and 4 to 8, the connecting section 4 can also have at least one manually operated releasing element 23, with the aid of which the locking connection 21 can be undone. The locking connection 21 comprises at least one locking element 24, which interacts with a complementary counter locking element 25 to lock the connecting section 4 to the housing cover 8. In the embodiment shown in FIGS. 2*a* to 2*c*, the locking element 24 is formed by a spring-elastic locking hook, which is integrally formed on the connecting section 4 and is likewise labelled 24 below. The counter locking element 25 is a counter bearing, which is integrally formed on the housing cover 8 and defines a locking contour that can engage behind the locking hook 24. The releasing element 23 is in this case formed by a manually operated section of the locking hook 24, by means of which the locking hook 24 can be moved manually out of the counter locking element 25 in order to undo the locking connection 21. In the embodiment shown in FIGS. 4 and 5, the locking element 24 and the releasing element 23 are likewise integrated in each other. In the embodiment shown in FIGS. 6 to 8, the releasing element 23 is also formed by an integral constituent of the locking element 24.

As can also be seen in FIGS. 2 and 4 to 8, at least one positioning element 26 can be formed on the connecting section 4, while at least one complementary counter positioning element 27 is formed on the housing cover 8. When the connecting section 4 is mounted on the housing cover 8, the respective positioning element 26 and the respective counter positioning element 27 interact to position and align the connecting section 4 relative to the housing cover 8. In the preferred examples shown here, the positioning element 26 and the associated counter positioning element 27 are wedge- or ramp-shaped, the wedge or ramp shape relating to the assembly direction 22. When the connecting section 4 is mounted on the housing cover 8, the respective positioning element 26 can then interact with the associated counter positioning element 27 in such a manner that they drive the connecting section 4 transversely to the assembly direction 22, namely axially, that is, parallel to a longitudinal centre axis 28 present in the connection between connecting section 4 and housing cover 8. In the embodiment shown in FIGS. 2*a* to 2*c*, the respective positioning element 26 is arranged on the connecting section 4 separately from the locking element 24 and separately from the releasing element 23. The corresponding situation applies to the embodiment shown in FIGS. 6 to 8. In contrast to this, in the embodiment shown in FIGS. 4 and 5, such a positioning element 26 is integrated in the locking element 24 or in the releasing element 23.

As can be seen in particular in FIG. 3, the connecting section 4 can be composed of two shell bodies 4' and 4". The shell bodies 4' and 4" are each produced in one piece as injection-moulded parts. They can for example be fused to each other or clipped to each other to form the connecting section 4.

Figure 6:
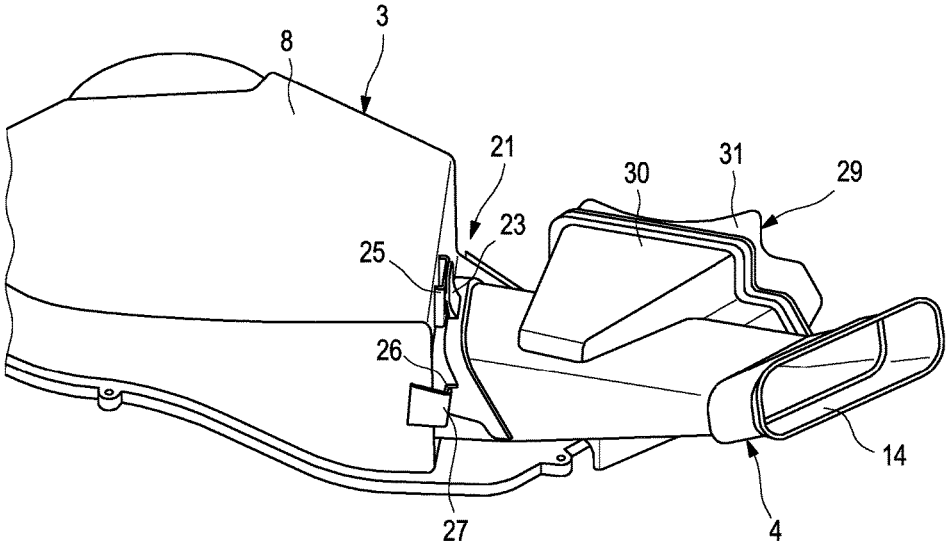
Figure 7:
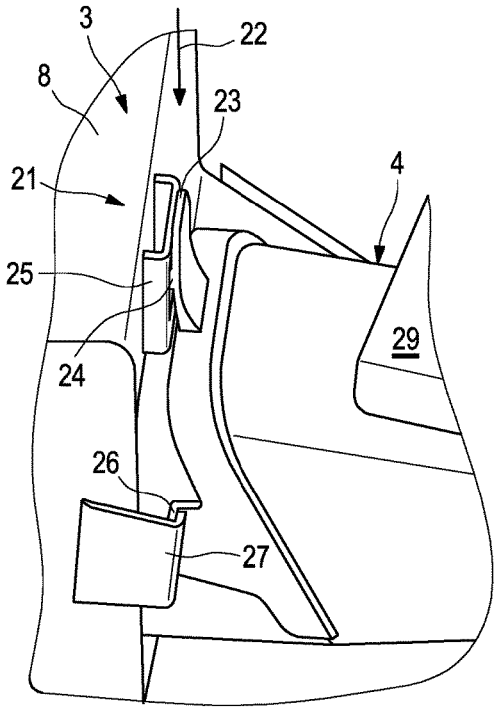
Figure 8:
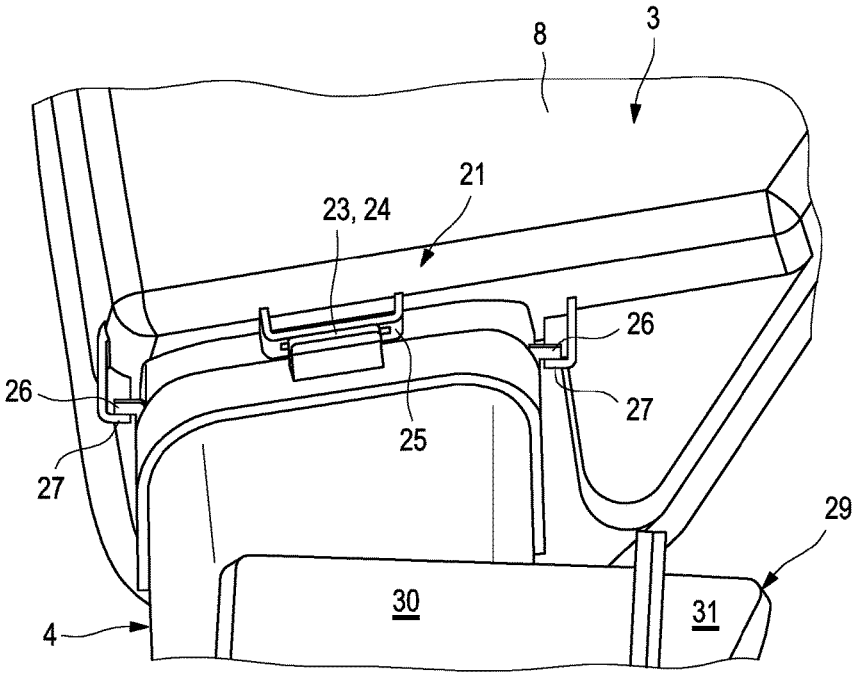

In the embodiment shown in FIGS. 6 to 8, a resonator 29 is arranged on the connecting section 4. The resonator 29 has a resonator housing 30, in which there is a resonance chamber and which is closed with a resonator cover 31. The resonance chamber is connected acoustically to the air-conducting interior of the connecting section 4. The resonator housing 30 is integrally formed on the connecting section 4 in this case. In contrast, the resonator cover 31 is designed as a separate component and built onto the resonator housing 30. A fused connection or a clip connection or an adhesive connection can be used here.

As can also be seen in FIG. 3, according to an advantageous embodiment, the inlet section 2 can also be composed of two shell bodies 2' and 2", which are preferably each produced in one piece as injection-moulded parts and are attached to each other in a suitable manner. In the example, each of the two shell bodies 2', 2" has a section with a cross section that is closed in the circumferential direction 18 and a section that is open in the circumferential direction 18. The two sections with the respectively open cross section complete each other when assembled to form a closed cross section, so the assembled inlet section 2 continuously has a closed cross section from the inlet end to the outlet end. One shell body 2' comprises the section with a closed cross section on the inlet side, while the other shell body 2" has the section with a closed cross section on the outlet side. The individual shell bodies 2', 2" can be injection-moulded more easily thereby, in such a manner that the assembled inlet section 2 has a relatively complex spatial structure, with which the inlet region defines a different flow direction from the outlet region.

In the examples of FIGS. 1 to 5, a clean-side air outlet 32 of the air filter 3 is formed on the housing cover 8.

Figure 2A:
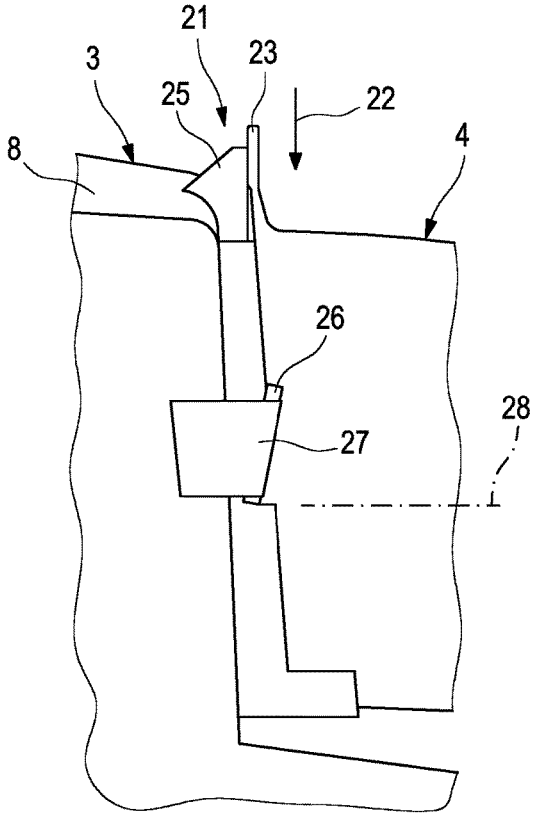
Figure 2B:
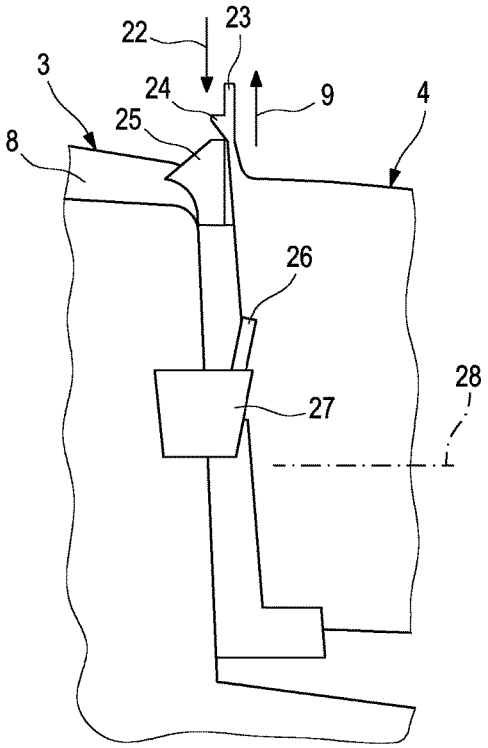
Figure 2C:
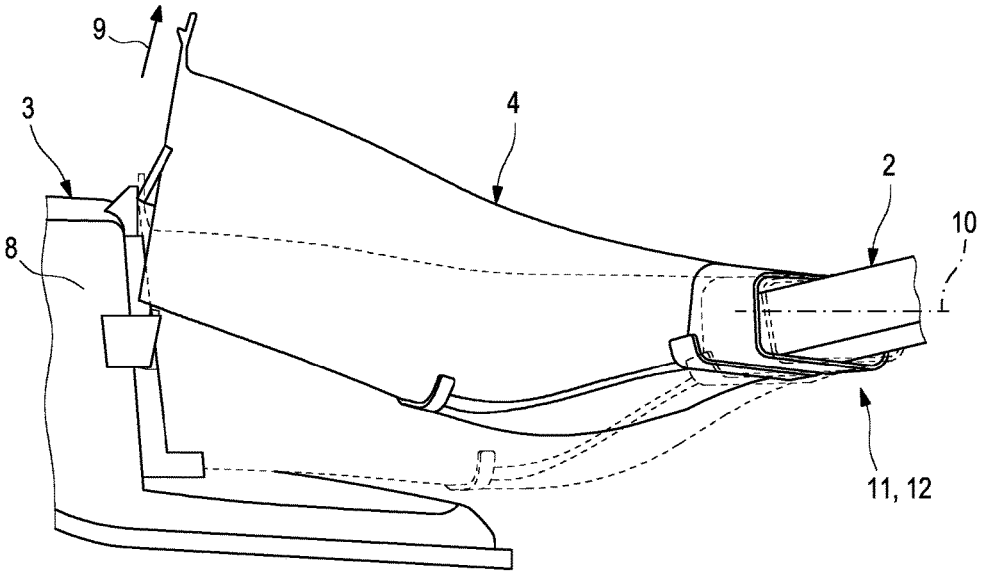

The way in which the exhaust system presented here functions is explained in more detail representatively using FIGS. 2*a* to 2*c*.

To change the filter element, the housing cover 8 must be removed from the filter housing 7. In order to be able to remove the housing cover 8 from the filter housing 7, the connecting section 4 must be removed from the housing cover 8 beforehand. FIG. 2*a* shows the assembled state, that is, the initial state, in which the connecting section 4 is locked to the housing cover 8. The locking hook 24 can be pressed away from the housing cover 8 perpendicularly to the assembly direction 22 and parallel to the axial direction 28 by manual operation of the releasing element 23, as a result of which the locking element 24 comes free of the counter locking element 25 and the connecting section 4 can be adjusted relative to the housing cover 8 counter to the assembly direction 22 in the movement direction 9. FIG. 2*b* shows a state in which the locking connection 21 is undone. The connecting section 4 according to FIG. 2*c* can then be pivoted further about the pivot axis 10 relative to the housing cover 8 in accordance with the movement direction 9, until the housing cover 8 can be taken off the filter housing 7. After the filter element has been changed, assembly takes place in the reverse order. First, the housing cover 8 is placed onto the filter housing 7. Then the connecting section 4 can be pivoted back about the pivot axis 10, as a result of which the connecting section 4 moves in the assembly direction 22 on the outlet side. The respective positioning element 26 in conjunction with the associated counter positioning element 27 effects the desired alignment and positioning between connecting section 4 and housing cover 8. When the end position is reached, the respective locking element 24 locks with the associated counter locking element 25 and secures the assembly position.

The invention claimed is:

1. A fresh air system for an internal combustion engine, comprising:

an inlet section configured to fixedly connect to a periphery of an engine component, an air filter including a filter element arranged in a filter housing, the filter housing configured to fixedly connect to the periphery of the engine component, and a housing cover coupled to the filter housing for closing the filter housing, wherein the housing cover is removable from the filter housing to change the filter element, a connecting section defining at least part of a fluid connection of the inlet section to the air filter, wherein the connecting section is movably connected to the inlet section on an inlet side and is detachably connected to the housing cover on an outlet side, at least one positioning element disposed on the connecting section, the at least one positioning element interacting with at least one complementary contour positioning element disposed on the housing cover to position or align the connecting section relative to the housing cover, wherein, to change the filter element when the inlet section is connected to the connecting section, the connecting section is detachable from the housing cover and adjustable relative to the filter housing to such an extent that the housing cover can be removed from the filter housing, and wherein the connecting section is movably connected to the inlet section around a pivot axis to produce a rotary movement for the connecting section about the pivot axis.

2. The fresh air system according to claim 1, wherein the inlet section is connected to the connecting section via a plug-in connection, the plug-in connection including an inner part inserted axially into an outer part, wherein a radial gap is formed between the inner part and the outer part, and wherein an elastic compensating body is arranged in the radial gap and extending in a circumferential direction about a longitudinal axis of the plug-in connection.

3. The fresh air system according to claim 2, wherein the compensating body is a foam body.

4. The fresh air system according to claim 2, wherein the plug-in connection has an axial overlap between the inner part and the outer part that is at least as large as a diameter of the inner part.

5. The fresh air system according to claim 2, wherein the compensating body projects axially over the plug-in connection.

6. The fresh air system according to claim 2, wherein the plug-in connection defines a flat cross section having a long diameter and, transversely thereto, a comparatively short diameter.

7. The fresh air system according to claim 1, wherein the connecting section is fixable to the housing cover via a locking connection, and wherein the locking connection has an assembly direction.

8. The fresh air system according to claim 7, wherein the plug-in connection defines a flat cross section having a long diameter and a comparatively short diameter extending transversely thereto, and wherein the assembly direction runs substantially perpendicular to the long diameter of the cross section of the plug-in connection.

9. The fresh air system according to claim 1, wherein the connecting section includes a first flat cross section on the inlet section and a second flat cross section on the housing cover, wherein the second flat cross section is rotated approximately 90° in relation to the first flat cross section.

10. The fresh air system according to claim 1, wherein the connecting section is connected to the housing cover via a locking connection, and wherein the locking connection has at least one manually operated releasing element for unlocking the locking connection.

11. The fresh air system according to claim 1, wherein the at least one positioning element and the at least one counter positioning element is wedge-shaped or ramp-shaped and drives the connecting section against the housing cover in an axial direction along a longitudinal centre axis of the connection between the connection section and the housing cover when the connecting section is mounted on the housing cover.

12. The fresh air system according to claim 1, wherein the connecting section is composed of two shell bodies each formed in one piece as injection-moulded parts.

13. The fresh air system according to claim 1, further comprising a resonator arranged on the connecting section.

14. The fresh air system according to claim 13, wherein the resonator has a resonator housing arranged integrally on the connecting section, and a separate resonator cover secured to the resonator housing.

15. The fresh air system according to claim 2, wherein the connecting section includes a first flat cross section on the inlet section and a second flat cross section on the housing cover, wherein the second flat cross section is rotated approximately 90° in relation to the first flat cross section.

16. The fresh air system according to claim 2, wherein the connecting section is connected to the housing cover via a locking connection, and wherein the locking connection includes at least one releasing element for unlocking the locking connection.

17. The fresh air system according to claim 2, wherein the connecting section is securable to the housing cover via a locking connection.

18. The fresh air system according to claim 3, wherein the foam body projects axially over the plug-in connection.

19. A fresh air system of an internal combustion engine, comprising:

an inlet section fixedly connected to a periphery of an engine component;

an air filter including a filter housing, a filter element arranged in the filter housing, and a housing cover closing the filter housing, wherein the housing cover is removable from the filter housing and the filter housing is fixedly connected to the periphery of the engine component;

a connecting section fluidly connecting the inlet section to the air filter, wherein the connecting section is movably connected to the inlet section on an inlet side and is detachably connected to the housing cover on an outlet side;

a plug-in connection connecting the inlet section to the connecting section, the plug-in connection including an inner part axially inserted into an outer part, a radial gap disposed between the inner part and the outer part, and an elastic compensating body arranged in the radial gap extending along a circumferential direction about a longitudinal axis of the plug-in connection; and a locking connection connecting the connecting section to the housing cover;

wherein, to remove the housing cover when the inlet section is connected to the connecting section, the connecting section is detachable from the housing cover and adjustable relative to the filter housing an extent facilitating removal of the housing cover from the filter housing; and wherein the connecting section is movably connected to the inlet section around a pivot axis to produce a rotary movement for the connecting section about the pivot axis.

* * * * *